US007422039B2

(12) United States Patent
Chisholm et al.

(10) Patent No.: US 7,422,039 B2
(45) Date of Patent: Sep. 9, 2008

(54) FLUID TRANSFER APPARATUS

(75) Inventors: Ronald R. Chisholm, Truro (CA); Peter Alex, Cloverville (CA)

(73) Assignee: Scepter Corporation, Scarborough, Ontario (CA)

( * ) Notice: Subject to any disclaimer, the term of this patent is extended or adjusted under 35 U.S.C. 154(b) by 369 days.

(21) Appl. No.: 10/851,668

(22) Filed: May 24, 2004

(65) Prior Publication Data

US 2005/0106048 A1 May 19, 2005

(30) Foreign Application Priority Data

Sep. 19, 2003 (CA) ..... 2 441 991

(51) Int. Cl.
*B65B 1/04* (2006.01)
*B65B 3/04* (2006.01)

(52) U.S. Cl. ..... 141/323; 141/25; 239/525

(58) Field of Classification Search ..... 417/571, 417/472, 510; 141/323, 21, 25, 26, 23; 239/525
See application file for complete search history.

(56) References Cited

U.S. PATENT DOCUMENTS

| | | | |
|---|---|---|---|
| 2,066,977 | A | 1/1937 | Iler |
| 3,570,765 | A | 3/1971 | De Gast |
| 3,675,672 | A | 7/1972 | Freeman |
| 3,677,020 | A | 7/1972 | Munselle |
| 3,747,643 | A | 7/1973 | Freeman |
| 3,783,888 | A | 1/1974 | Johnson |
| 3,836,079 | A | 9/1974 | Huston |
| 3,841,764 | A | 10/1974 | Snell et al. |
| 3,856,036 | A | 12/1974 | Drews et al. |
| 3,863,843 | A | 2/1975 | Hechler, IV |
| 3,907,205 | A | 9/1975 | Shreve |
| 3,976,227 | A | 8/1976 | Ray |
| 3,995,326 | A | 12/1976 | Umann |
| 4,022,347 | A | 5/1977 | Noble |
| 4,043,341 | A | 8/1977 | Tromovitch |
| 4,053,012 | A | 10/1977 | Farmer |
| 4,095,615 | A | 6/1978 | Ramsauer |
| 4,105,438 | A | 8/1978 | Sherwood |

(Continued)

FOREIGN PATENT DOCUMENTS

| | | |
|---|---|---|
| DE | 54 890 | 1/1891 |

(Continued)

OTHER PUBLICATIONS

U.S. Appl. No. 10/460,807, entitled Container Shut-Off Valve With Venting, filed Jun. 13, 2003.

(Continued)

*Primary Examiner*—Devon Kramer
*Assistant Examiner*—Peter J Bertheaud
(74) *Attorney, Agent, or Firm*—McCormick, Paulding & Huber LLP

(57) ABSTRACT

An apparatus for transferring a fluid from a supply container to a desired receptacle. The apparatus includes a conduit having a fluid passage with a valve seat and a flexible containment member. A moveable sealing member is coupled to the flexible containment member and is configured for sealingly engaging the valve seat. An activator is coupled to the sealing member for displacing the sealing member from the valve seat to effect the creation of a reduced fluid pressure in the fluid in the supply container.

11 Claims, 6 Drawing Sheets

U.S. PATENT DOCUMENTS 4,112,963 A 9/1978 Brubaker
4,208,172 A 6/1980 Dill
4,232,694 A 11/1980 Williams
4,240,583 A 12/1980 Hughes
4,243,396 A 1/1981 Cronenberg
4,253,957 A 3/1981 Sullivan
4,273,166 A 6/1981 Bradley
4,301,826 A 11/1981 Beckerer
4,326,641 A 4/1982 Wilken
4,343,282 A 8/1982 Glenn
4,345,694 A 8/1982 Chambers
4,345,718 A 8/1982 Horvath
4,361,163 A 11/1982 Aigo
4,411,756 A 10/1983 Bennett et al.
4,429,809 A 2/1984 Bousgarbies
4,436,617 A 3/1984 Moore et al.
4,456,476 A 6/1984 Sherwood
4,462,124 A 7/1984 Antos et al.
4,474,111 A 10/1984 Holzhauser
4,485,518 A 12/1984 Kasper
4,489,890 A 12/1984 Martin
4,537,007 A 8/1985 Lattanzi
4,537,334 A 8/1985 Spengler et al.
4,595,399 A 6/1986 Collins et al.
4,606,477 A 8/1986 Spengler et al.
4,615,511 A 10/1986 Sherwood
4,629,098 A 12/1986 Eger
4,640,446 A 2/1987 Walker
4,683,067 A 7/1987 Aleman et al.
4,698,469 A 10/1987 Pham et al.
4,709,859 A * 12/1987 Schulze et al. ..... 239/525
4,723,337 A 2/1988 Ellison et al.
4,724,683 A 2/1988 Johnson
4,781,329 A 11/1988 Tenney et al.
4,788,973 A 12/1988 Kirchgeorg et al.
4,797,206 A 1/1989 Lynch
4,815,505 A 3/1989 Ibanez
4,824,579 A 4/1989 George
4,829,624 A 5/1989 Lackner et al.
4,839,106 A 6/1989 Steiner
4,840,652 A 6/1989 Simon et al.
4,842,643 A 6/1989 Van Wijk
4,890,646 A 1/1990 Dumser
4,947,739 A 8/1990 Owen
4,971,248 A 11/1990 Marino
4,972,972 A 11/1990 Goguen
5,022,114 A 6/1991 Kauffeldt et al.
5,040,703 A 8/1991 Roark et al.
5,046,645 A 9/1991 Hagan et al.
5,052,443 A 10/1991 Evangelist, Jr.
5,055,856 A 10/1991 Tomii et al.
5,075,992 A 12/1991 Kahn
5,098,428 A 3/1992 Sandlin et al.
5,143,294 A 9/1992 Lintvedt
5,176,327 A * 1/1993 Petersen et al. ..... 239/526
5,244,021 A 9/1993 Hau
5,267,676 A 12/1993 Lord et al.
5,303,842 A 4/1994 Harp et al.
5,333,639 A 8/1994 Nelson
5,392,957 A 2/1995 Parsons
5,438,721 A 8/1995 Pahno et al.
5,472,124 A 12/1995 Martushev
5,540,355 A 7/1996 Hancock et al.
5,597,097 A 1/1997 Morris
5,598,955 A 2/1997 Reilley
5,624,059 A 4/1997 Lo
5,638,609 A 6/1997 Chandran et al.
5,638,872 A 6/1997 Porter
5,638,994 A 6/1997 Libit et al.
5,718,260 A 2/1998 Leonardi
5,775,595 A 7/1998 Knodel et al.
5,787,722 A 8/1998 Jenkins
5,855,024 A 1/1999 Smith
6,068,163 A 5/2000 Kihm
6,073,811 A 6/2000 Costea
6,283,137 B1 9/2001 Malecki
6,287,521 B1 9/2001 Quay et al.
6,371,332 B1 4/2002 Fox
6,412,528 B1 * 7/2002 Alex et al. ..... 141/323
6,616,067 B1 9/2003 Hunter
6,659,373 B1 * 12/2003 Heren et al. ..... 239/570
D509,559 S 9/2005 Chishom et al.
2001/0013381 A1 8/2001 Nagel et al.

FOREIGN PATENT DOCUMENTS

DE 873 661 4/1953
GB 2 170 430 A 8/1986

OTHER PUBLICATIONS

U.S. Appl. No. 10/549,786, entitled Fluid Transfer Apparatus, filed Mar. 19, 2003.
U.S. Appl. No. 10/851,669, entitled System for Effecting Liquid Transfer From an Elevated Supply Container, filed May 24, 2004.
U.S. Appl. No. 29/201,680, entitled Fluid Transfer Apparatus, filed Mar. 19, 2004.
U.S. Appl. No. 10/460,415.

* cited by examiner

FLUID TRANSFER APPARATUS

FIELD OF THE INVENTION

This invention relates to an apparatus for effecting the transfer of a fluid and, more particularly, to an apparatus for siphoning liquids from a supply container to a receiving container.

BACKGROUND OF THE INVENTION

Liquids must often be transferred between a storage container and an on-board receptacle of an apparatus which is supplied the liquid from the receptacle and then subsequently processes the liquid. Such an on-board storage receptacle may be a gas tank on an automobile, snow mobile, or a lawnmower. Known systems for effecting transfer of liquid between such containers suffer from various disadvantages. For instance, existing fluid transfer systems are susceptible to spillage, are difficult to control, are prone to unacceptable rates of leakage due to excessive use of plastic flexible materials being relatively permeable to certain liquids (such as gasoline), or suffer from unnecessary energy losses.

SUMMARY OF THE INVENTION

The present invention provides a combination of a supply container and a fluid transfer apparatus, the fluid transfer apparatus disposed in fluid communication disposition with the liquid in the supply container to thereby effect creation and communication of a reduced fluid pressure relative to a fluid pressure of the liquid in the supply container and thereby initiating flow of the liquid from the supply container, the fluid transfer apparatus comprising a frame, a conduit coupled to the frame and defining a fluid passage, the fluid passage including an inlet, and outlet, and an orifice defined by a valve seat, and the conduit including a conduit section having a flexible containment member and defining a first fluid passage section comprising a space capable of changing its volume, a moveable sealing member, coupled to the flexible containment member, and configured to sealingly engaging the valve seat and an actuator, pivotally coupled to the frame, and coupled to the sealing member to effect displacement of the sealing member relative to the valve seat in response to pivotal movement of the actuator relative to the frame, wherein displacement of the sealing member from the valve seat by the actuator effects the creation and communication of the reduced fluid pressure to the liquid in the supply container.

The present invention also provides the combination wherein the first fluid passage section is defined between a first valve means and a second valve means, each of the first and second valve means being disposed in the first fluid passage, wherein the first valve means is configured to prevent fluid flow from the space and to the inlet, and wherein the second valve means is configured to prevent fluid flow from the outlet to the space.

The present invention further provides the combination wherein the first valve means is biased to seal fluid communication between the inlet and the space, and the second valve mans is biased to seal fluid communication between the space and outlet.

The present invention further provides the combination wherein the first valve means is configured to open in response to a fluid pressure differential between the inlet and the space, wherein fluid pressure in the space is less than fluid pressure at the inlet, sufficient to overcome the bias of the first valve means to seal fluid communication between the inlet and the space.

The present invention further provides the combination wherein the second valve means is configured to open in response to a fluid pressure differential between the space and the outlet, wherein fluid pressure in the space is greater than the fluid pressure at the outlet, sufficient to overcome the bias of the second valve means to seal fluid communication between the space and the outlet.

The present invention further provides the combination wherein the displacement of the sealing member from the valve seat effects expansion of the space to thereby effect a reduced fluid pressure in the space sufficient to create the sufficient fluid pressure differential between the inlet and the space to overcome the bias of the first valve means to seal fluid communication between the inlet and the space.

The present invention further provides the combination wherein the flexible containment member is a flexible diaphragm.

The present invention further provides the combination wherein the sealing member is biased to sealingly engage the valve seat.

The present invention also provides a fluid transfer apparatus configured for fluid communication disposition with liquid in a supply container to thereby effect creation and communication of a reduced fluid pressure relative to a fluid pressure of the liquid in the supply container and thereby indicating flow of the liquid from the supply container, the fluid transfer apparatus comprising a frame, a conduit coupled to the frame and defining a fluid passage, the fluid passage including an inlet, and outlet, an orifice defined by a valve seat, and the conduit including a conduit section having a flexible containment member and defining a first fluid passage section comprising a space capable of changing its volume, a moveable sealing member, coupled to the flexible containment member, and configured to sealingly engaging the valve seat, and an actuator, pivotally coupled to the frame, and coupled to the sealing member to effect displacement of the sealing member relative to the valve seat in response to pivotal movement of the actuator relative to the frame, wherein displacement of the sealing member from the valve seat by the actuator effects the creation and communication of the reduced fluid pressure to the liquid in the supply container.

The present invention provides the combination wherein the first fluid passage section is defined between a first valve means and a second valve means, each of the first and second valve means being disposed in the first fluid passage, wherein the first valve means is configured to prevent fluid flow from the space and to the inlet, and wherein the second valve means is configured to prevent fluid flow from the outlet to the space.

The present invention further provides the combination wherein the first valve means is biased to seal fluid communication between the inlet and the space, and the second valve mans is biased to seal fluid communication between the space and outlet.

The present invention further provides the combination wherein the first valve means is configured to open in response to a fluid pressure differential between the inlet and the space, wherein fluid pressure in the space is less than fluid pressure at the inlet, sufficient to overcome the bias of the first valve means to seal fluid communication between the inlet and the space.

The present invention also provides the combination wherein the second valve means is configured to open in response to a fluid pressure differential between the space and the outlet, wherein fluid pressure in the space is greater than the fluid pressure at the outlet, sufficient to overcome the bias of the second valve means to seal fluid communication between the space and the outlet.

The present invention further provides the combination wherein the displacement of the sealing member from the valve seat effects expansion of the space to thereby effect a reduced fluid pressure in the space sufficient to create the sufficient fluid pressure differential between the inlet and the space to overcome the bias of the first valve means to seal fluid communication between the inlet and the space.

The present invention further provides the combination wherein the flexible containment member is a flexible diaphragm.

The present invention further provides the combination wherein the sealing member is biased to sealingly engage the valve seat.

The present invention further provides a fluid transfer apparatus configured for fluid communication disposition with liquid in a supply container to thereby effect creation and communication of a reduced fluid pressure relative to a fluid pressure of the liquid in the supply container and thereby initiate flow of the liquid from the supply container, comprising a frame, a conduit coupled to the frame and defining a fluid passage, the fluid passage including an inlet, and outlet, and an orifice defined by a valve seat, the conduit including a conduit section having a flexible containment member and defining a first fluid passage section comprising a space capable of changing its volume, a moveable sealing member, coupled to the flexible containment member, and configured for sealingly engaging the valve seat, an actuator, pivotally coupled to the frame, and configured to effect displacement of the sealing member relative to the valve seat in response to pivotal movement of the actuator relative to the frame, and locking means pivotally coupled to the frame and configured to engage the actuator to prevent the actuator from effecting displacement of the sealing member when the sealing member is sealingly engaged to the valve seat, wherein displacement of the sealing member from the valve seat by the actuator effects the creation and communication of the reduced fluid pressure to the liquid in the supply container.

The present invention further provides the fluid transfer apparatus wherein the locking means is moveable between a locking condition and a disabled condition such that, in the locking condition, the locking means prevents the actuator from effecting displacement of the sealing member when the sealing member is sealingly engaged to the valve seat, and in the disabled condition, the actuator is moveable to effect displacement of the sealing member.

The present invention provides the fluid transfer apparatus wherein the frame includes a first receiving means for releasably engaging the locking means in the locking condition, and a second receiving means for releasably engaging the locking means in the disabled condition.

The present invention provides the fluid transfer apparatus wherein the locking means is configured to effect snap fit engagement with each of the first and second receiving means.

The present invention further provides the fluid transfer apparatus wherein each of the first and second receiving means is a groove provided in the frame.

The present invention further provides a fluid transfer apparatus configured for fluid communication disposition with liquid in a supply container to thereby effect creation and communication of a reduced fluid pressure relative to a fluid pressure of the liquid in the supply container and thereby initiate flow of the liquid from the supply container, comprising a frame, a conduit coupled to the frame and defining a fluid passage, the fluid passage including an inlet, and outlet, and an orifice defined by a valve seat and having an orifice axis, the conduit including a conduit section having a flexible containment member and defining a first fluid passage section comprising a space capable of change to its volume, the first fluid passage section including a first fluid passage subsection having an axis orthogonal to the orifice axis, a moveable sealing member coupled to the flexible containment member, and configured for sealingly engaging the valve seat, an actuator pivotally coupled to the frame, and configured to effect displacement of the sealing member relative to the valve seat in response to pivotal movement of the actuator relative to the frame, wherein displacement of the sealing member from the valve seat by the actuator effects creation and communication of the reduced fluid pressure to the liquid in the supply container, and upon the displacement, the sealing member becomes disposed in the first fluid passage subsection.

The present invention further provides the fluid transfer apparatus wherein the sealing member includes a sealing surface having a sealing surface axis, such that when the sealing member is disposed in the first fluid passage subsection, the sealing surface axis is orthogonal to the fluid passage subsection axis.

BRIEF DESCRIPTION OF THE DRAWINGS

This invention will be better understood by reference to the following detailed description of the invention in conjunction with the following drawings, in which.

DETAILED DESCRIPTION OF THE INVENTION

Figure 1:
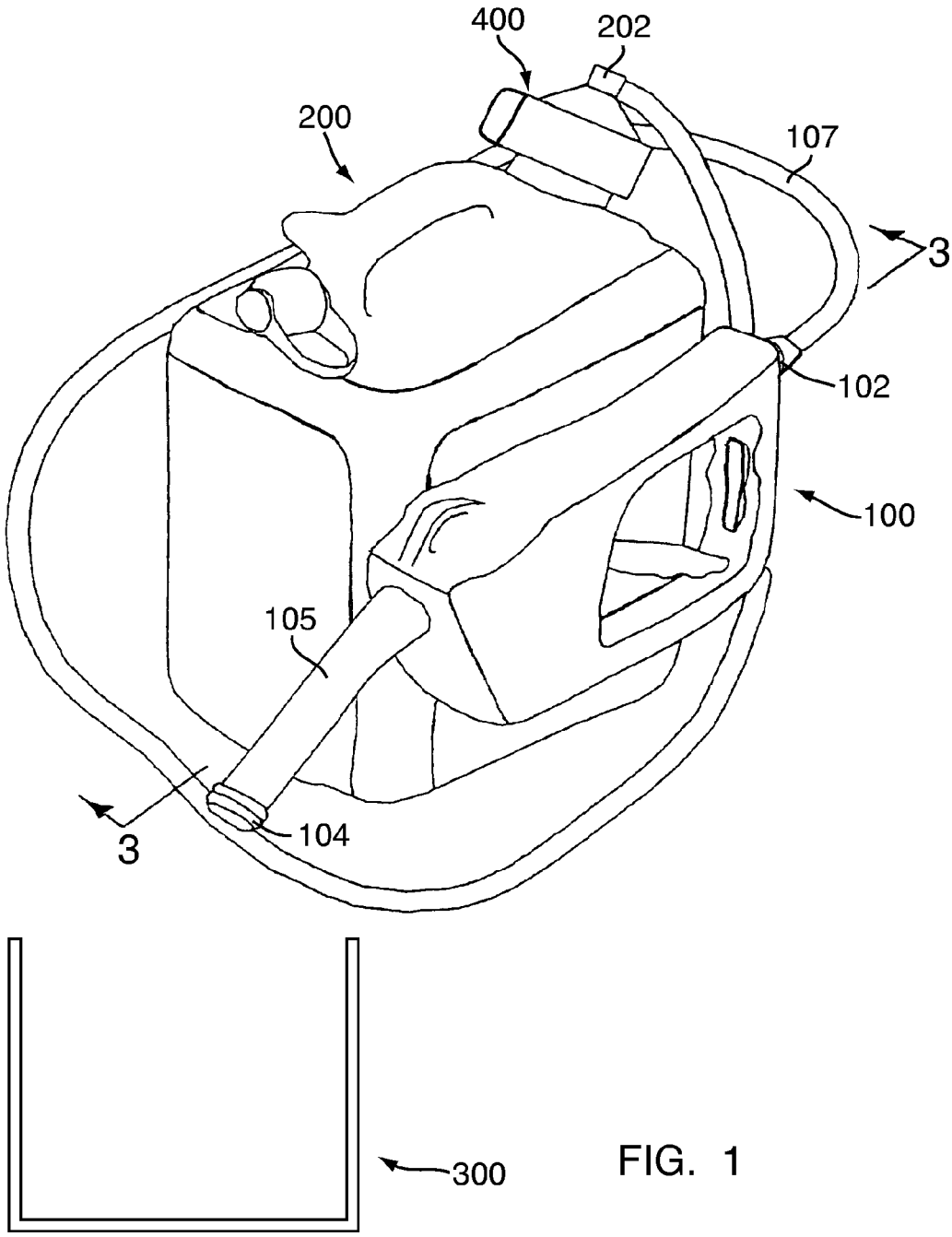
FIG. 1 is a top perspective view of an embodiment of a fluid transfer apparatus of the present invention coupled to a supply container.

Referring to FIG. 1, the present invention provides a fluid transfer apparatus 100 for effecting transfer of liquid from a supply container 200 to a receiving container 300, so long as the supply container 200 is elevated relative to the receiving container 300.

Figure 2:
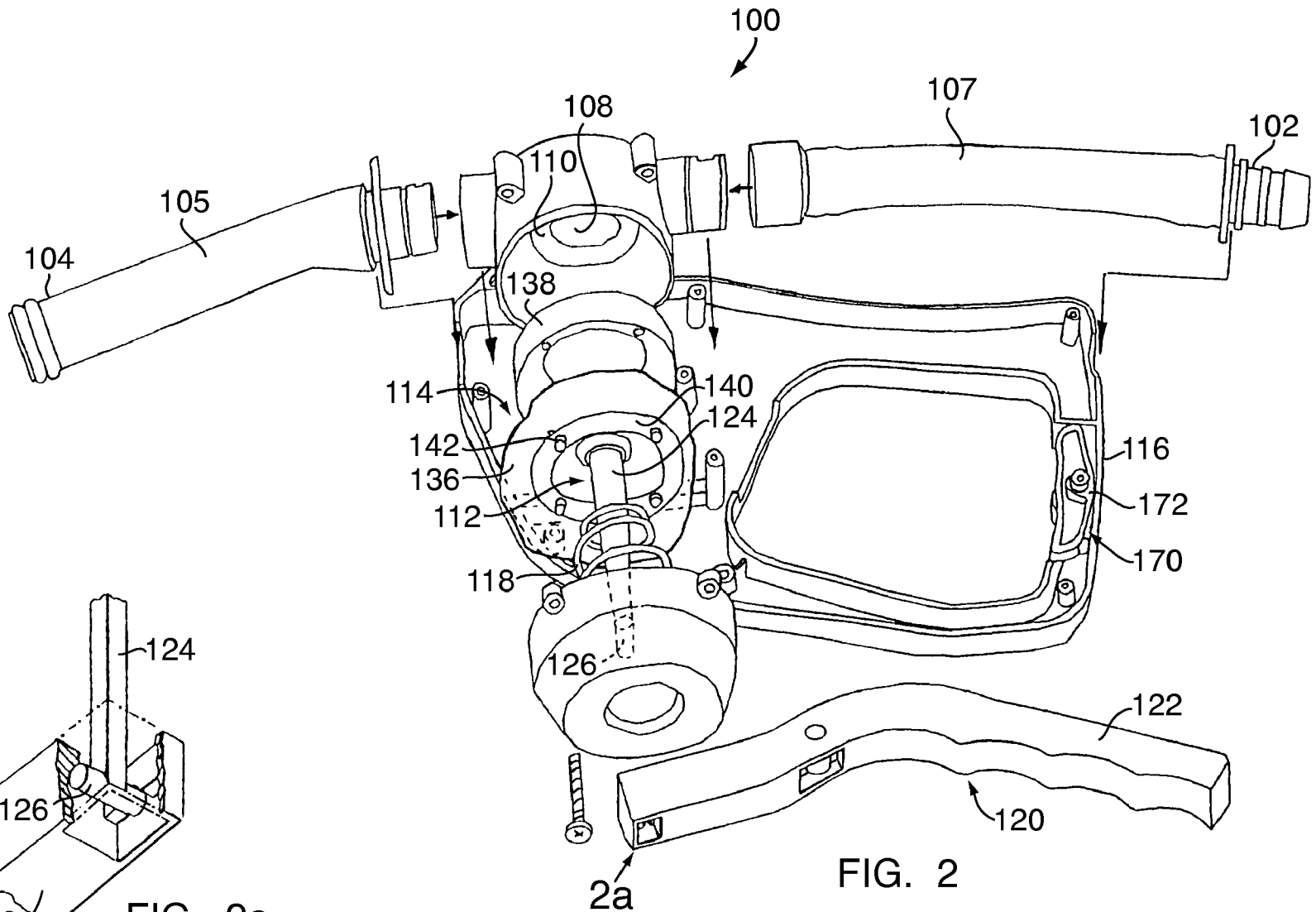
FIG. 2 is an exploded view from a bottom perspective of an embodiment of a fluid transfer apparatus of the present invention.
Figure 3:
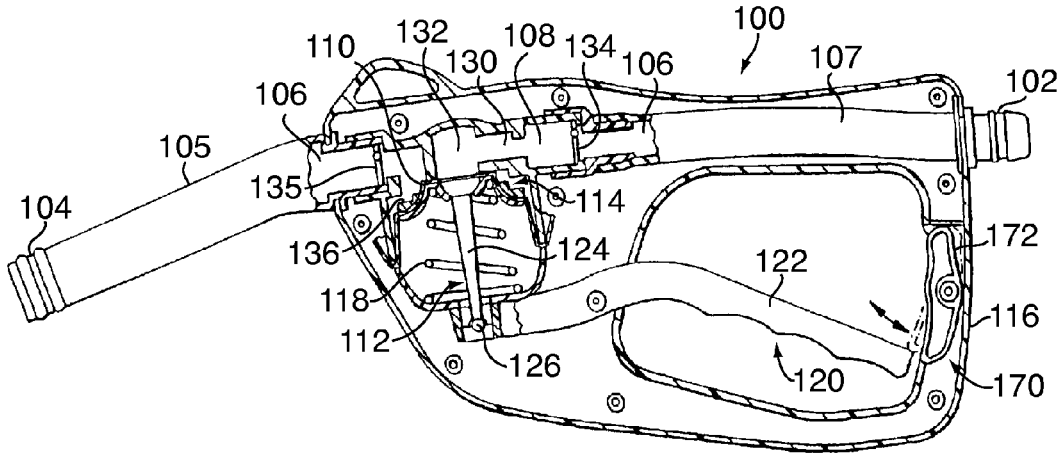
FIG. 3 is a sectional elevation view of the fluid transfer apparatus illustrated in FIG. 2, illustrating the valve in the closed position.

Referring to FIGS. 2 and 3, the fluid transfer apparatus 100 is provided to effect creation of a fluid pressure driving force for initiating flow of the liquid from the supply container 200 when the supply container 200 is elevated relative to the receiving container 300. In this respect, the fluid transfer apparatus 100 includes an inlet 102 configured for fluid communication disposition with the liquid in the supply container 200. The fluid transfer apparatus 100 also includes an outlet 104 for effecting discharge of the liquid flowed to the receiving container 300 from the supply container 200. The outlet 104 fluidly communicates with the inlet 102 via a conduit 105 defining a fluid passage 106. The conduit 105 is mounted to a frame 116 of the fluid transfer apparatus 100.

The fluid pressure driving force created by the fluid transfer apparatus 100 can take the form of a communication of a reduced fluid pressure to the liquid in the supply container 200, wherein such reduced fluid pressure is less than the fluid pressure of the liquid in the supply container 100. Such created fluid pressure differential initiates flow of the liquid from the supply container 200 and through the fluid transfer apparatus 100.

A fluid transfer apparatus 100 which also falls within the scope of the invention is one which, when disposed communication with the liquid in the supply container 200, is capable of initiating and effecting siphoning of the liquid from the supply container 200. The term "siphoning" is used herein to describe the process by which a liquid is transferred from a supply container 100 at a higher level, and over an intermediate elevation greater then the higher level, and then discharged at a lower level. Such transfer is effected by the pressure of the fluid in the supply container 200 forcing the liquid from the supply container 100 to the intermediate elevation. The excessive weight of the liquid in the fluid passage between the intermediate elevation and the discharge causes a continuous flow to be discharged.

Referring to FIGS. 3 to 7, as an example of a means to effect fluid communication between the supply container 200 and the fluid transfer apparatus 100, a flexible hose 107 defining the fluid passage 108 is coupled to the inlet 102 of the fluid transfer apparatus 100, and is also coupled to an inlet 202 of the supply container 200, thereby joining the fluid transfer apparatus 100 to the supply container 200. Optionally, a shut-off valve 400 can be interposed between the inlet 102 and the supply container 200 to effect independent isolation of the fluid transfer apparatus 100 from the supply container 200.

The outlet 104 communicates with atmospheric pressure, and is configured for effecting discharge of liquid being flowed through the fluid passage 106 to the receiving container 300 to effect transfer of liquid from the supply container 200 to the receiving container 300. An orifice 108 is provided in the fluid passage 106 between the inlet 102 and the outlet 104, and is defined by a valve seat 110.

A valve 112 is disposed in the fluid passage 106 and configured to control or prevent flow of fluid between the inlet 102 and the outlet 104. The valve 112 includes a sealing member 114 configured to sealingly engage the valve seat 110. The valve 112 is moveable relative to the valve seat 110, thereby controlling or preventing flow of fluid between the inlet 102 and the outlet 104. Sealing engagement of the sealing member 114 to the valve seat 110 effects sealing of fluid communication between the inlet 102 and the outlet 104.

The valve 112 is biased to sealingly engage the valve seat 110 by a compression spring 118. The compression spring 118 is coupled at one end to the valve 112, and coupled at a second end to the frame 116.

Figure 2A:
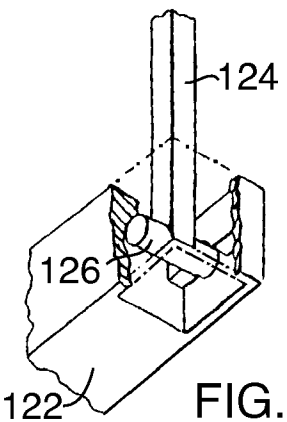
FIG. 2*a* is a fragmentary bottom perspective view of the lever of the fluid transfer apparatus illustrated in FIG. 2.

Displacement of the valve 112 from the valve seat 110 is effected by an actuator 120. The actuator 120 comprises a lever 122 pivotally coupled to the frame 116. The lever 122 is pivotally coupled to a valve stem 124 extending from the sealing member 114, to effect movement of the sealing member 114 relative to the valve seat 110. The valve stem 124 comprises an element of the valve 112. In the embodiment illustrated, the valve stem 124 includes a pin 126 disposed remote from the sealing member 114 and coupled to the lever 122 (see FIG. 2*a*).

The fluid passage 106 includes a fluid passage section 130 disposed between a first valve means 134 and a second valve means 135, and defining an expandable space 132. The fluid passage section 130 is defined by a conduit 133 including a flexible containment member 136, such as a diaphragm. The flexible containment member 136 is moveable upon application or removal of external or internal forces to effect expansion and contraction of the space 132.

Upon displacement from the valve seat 110, the sealing member 114 moves out of the way of the flow path between the inlet 102 and the outlet 104. In this respect, and specifically referring to FIG. 7, fluid passage section 130 includes a fluid passage section 160 having an axis 162 which is orthogonal to the axis 108*a* of the orifice 108. The sealing member 114 becomes disposed in the fluid passage section 160 upon displacement from the valve seat 110. As a result, interference of fluid flow between the inlet 102 and the outlet 104 is mitigated as the sealing surface area 117 of the sealing member 114 is not directly in the flow path of fluid flowing through fluid passage section 160 (i.e. the axis 117*a* of the sealing surface area 117 is orthogonal to the axis 162 of the fluid passage section 160).

In the illustrated embodiment, the flexible containment member 136 is coupled to the valve 112. In this respect, expansion and contraction of the space 132 occurs in concert with displacement of the valve 112 relative to the valve seat 110. The flexible containment member 136 is pressed between upper and lower diaphragm plates 138, 140 coupled to the valve stem 124. The flexible containment member 136 has sufficient surface area so as to permit travel of the valve 112 from a position whereby the orifice 108 is sealed to a retracted position (see FIG. 4) without stretching of the flexible containment member 136.

In the embodiment illustrated, the sealing member 114 is pivotally coupled to the valve stem 124 to facilitate pivotal or swiveling motion of the sealing member 114 relative to the valve stem 124. Such coupling of the sealing member 114 to the valve stem 124 permits self alignment of the sealing member 114 with the valve seat 110 during seating of the sealing member 114 on the valve seat 110.

The sealing member 114 is defined by a portion 136*a* of the flexible containment member 136 extending over and assuming the shape defined by a raised surface 141 disposed on the lower diaphragm plate 140. The upper diaphragm plate 138 includes an aperture 139 configured to facilitate extension of the sealing member 114 therethrough when the upper diaphragm plate 138 is secured to the lower diaphragm plate 140 (see FIG. 9).

The flexible containment member 136 extends across the lower diaphragm plate 140 and is interposed between the plates 138, 140. The upper diaphragm plate 138 is secured to the lower diaphragm plate 140 by a plurality of screws 142, and the flexible containment member 136 includes apertures for receiving the screws 142. In this respect, the flexible containment member 136 including the portion 136*a* is thereby secured and squeezed between the plates 138, 140.

The valve stem 124 includes a convex head 125*a* configured to engage and be supported by a mating concave seating area 125*b* provided in the lower diaphragm plate 140. Separation of the concave head 125*a* from the seating area 125*b* is limited or prevented by the flexible containment member 136. In this respect, the concave head 125*a* is retained in engagement with the seating area 125*b* by the flexible containment member 136. Such engagement between the concave head 125*a* and the seating area 125*b* creates the above-described pivotal coupling between (i) the valve stem 124 and (ii) the sealing member 114, which, therefore, facilitates the above-described swivel action of the sealing member 114 relative to the stem 124.

Figure 7:
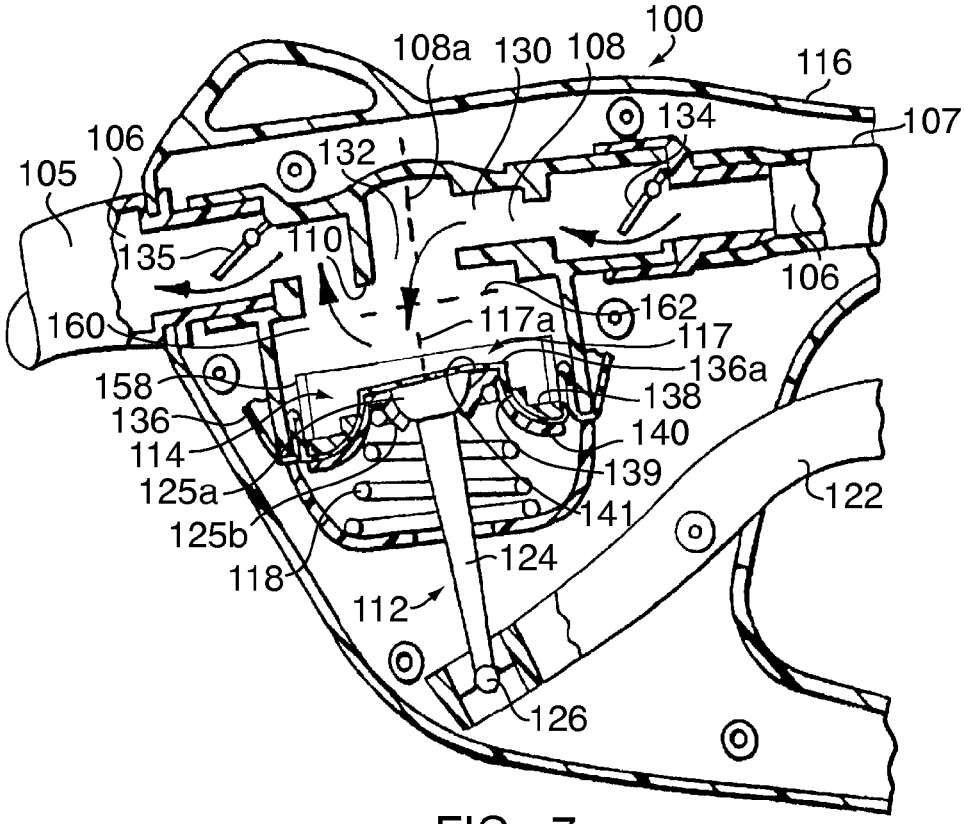
FIG. 7 is a detailed view of the valve mechanism of the fluid transfer apparatus in the condition illustrated in FIG. 6, and particularly illustrating the upstanding wall of the upper diaphragm plate which has been removed for clarity in FIGS. 3-6.
Figure 9:
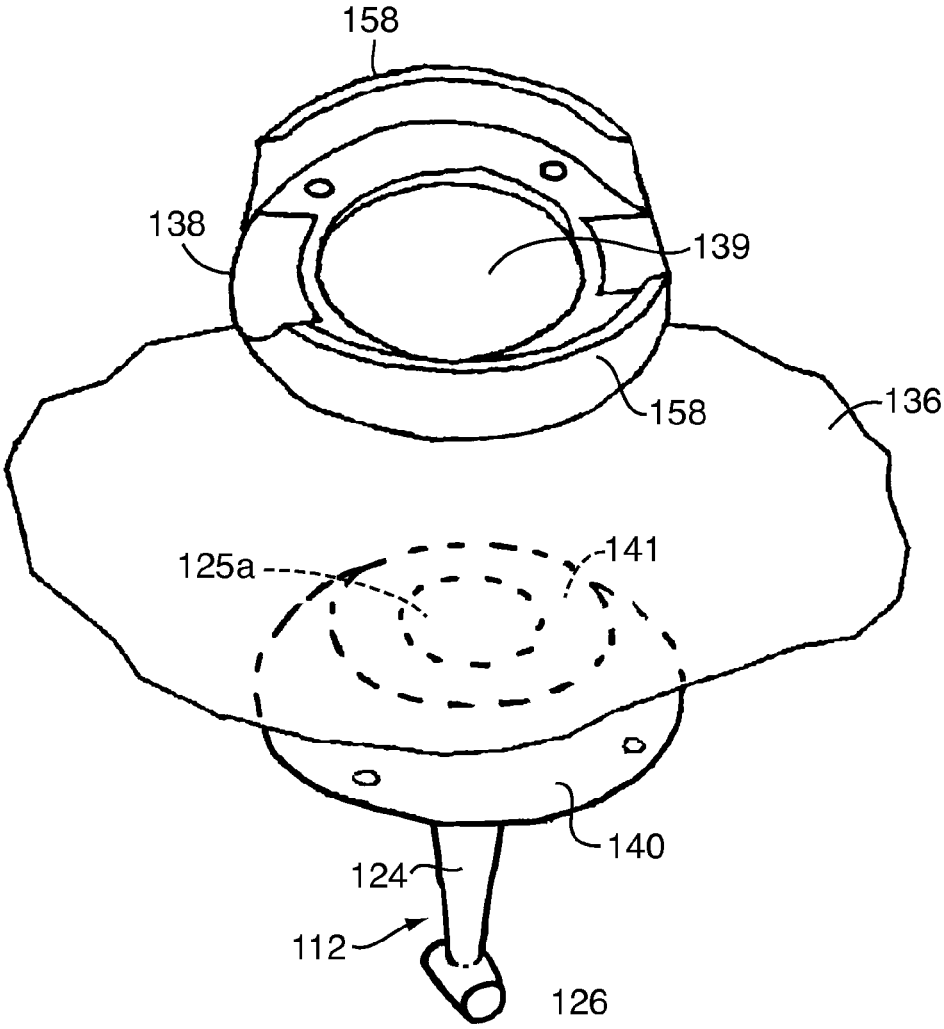
FIG. 9 is an exploded view from a top perspective of the upper diaphragm plate, the diaphragm, and the lower diaphragm plate (coupled to the valve stem) of an embodiment of the fluid transfer apparatus of the present invention.

Referring to FIGS. 7 and 9, the upper diaphragm plate 138 includes a peripherally disposed upstanding wall 158 extending peripherally about the edge of the plate 138. The upstanding wall 158 functions as a retainer to prevent the flexible containment member 136 from becoming pinched, or mitigate the risk of the flexible containment member 136 becoming pinched, between the upper diaphragm plate 138 and the non-flexible containment member portion (being relatively rigid) of the fluid passage section 130.

Movement of the flexible containment member 136 is coupled to displacement of the valve 112 relative to the valve seat 110. Upon actuation of the valve 112, such that the valve 112 becomes displaced from the valve seat 110, the flexible containment member 136 moves with valve 112, effecting expansion of the space 132. Return of the valve 112 to a seated condition against the valve seat 110 causes the flexible containment member 136 to effect contraction of the space 132.

In this respect, the flexible containment member 136, when coupled to the valve 112, functions as the flow actuator. As described above, displacement of the valve 112 from the valve seat 110 effects movement of the flexible containment member 136 so as to effect an expansion of the space 132 to an expanded condition. In concert, the sealing member 114 becomes displaced from the valve seat 110. Because of the expansion of the space 132, fluid pressure within the space 132 is reduced, and this is communicated to the first valve means 134 through the orifice 108, resulting in a pressure differential between the space 132 and the fluid passage 106 upstream of the first valve means 134, which overcomes a biasing force applied to the first valve means 134 urging the first valve means 134 to remain in a closed condition (when in the closed condition, the first valve means 134 seals fluid communication between the fluid passage 106 upstream of the first valve means 134 and the fluid passage section 130). This action initiates the flow of fluid (a liquid or a gas mixture) into the fluid passage section 130 from upstream of the first valve means 134.

As discussed above, the fluid passage 106 includes a first valve means 134 and a second valve means 135. In the embodiment illustrated, the first valve means 134 is disposed upstream of the orifice 108, whereas the second valve means 135 is disposed downstream of the orifice 108.

The first valve means 134 functions as a check valve, for preventing back flow of gas or a gas/liquid mixture from the space 132 to the inlet 102 (and then to the supply container 200). The first valve means 134 is biased by a first biasing force to assume a normally closed condition, whereby fluid communication between the space 132 and the inlet 102 (and the container 200 when coupled to the inlet 102) is sealed. The first valve means 134 is configured to assume an open condition, whereby fluid communication is effected between the inlet 102 and the space 132 to effect a transfer of fluid (a liquid or a gas) from the inlet 102 to the space 132 in response to a communication of a reduced fluid pressure in the space 132 attributable to the expansion of the space 132, such expansion effecting a fluid pressure differential between the inlet 102 and the space 132. The resultant fluid pressure differential force acts on the first valve means 134 and is eventually sufficient to overcome the first biasing force. Once the fluid pressure in the space 132 approaches the fluid pressure at the inlet 102, the first biasing force effects return of the first valve means 134 into the closed condition, thereby sealing fluid communication between the space 132 and the inlet 102. The first valve means 134 is configured to maintain a closed condition when the fluid pressure in the space 132 is greater than the fluid pressure upstream of the first valve means 134, such as at the inlet 102. In the embodiment shown, the first valve means 134 is a flapper valve.

The second valve means 135 also functions as a check valve, for preventing backflow of gas on a gas/liquid mixture from the outlet 104 to the space 132. The second valve means 135 is biased by a second biasing force to assume a normally closed condition, whereby fluid communication between the fluid passage section 130 and the outlet 104 (and the receiving container 300 when coupled to the outlet 104) is sealed. The second valve means 135 is configured to assume an open condition, whereby fluid communication is effected between the space 132 and the outlet 104 to effect a transfer of fluid (a liquid or a gas) from the space 132 to the outlet 104 in response to a communication of an increased fluid pressure in the space 132 attributable to the contraction of the space 132, such contraction effecting a fluid pressure differential between the space 132 and the outlet 104. The resultant fluid pressure differential force acts on the second valve means 135 and is eventually sufficient to overcome the second biasing force. Once the fluid pressure in the space 132 approaches the fluid pressure at the outlet 104, the second biasing force effects return of the second valve means 134 to the closed condition, thereby sealing fluid communication between the space 132 and the outlet 104. The second valve means 135 is configured to maintain a closed condition when the fluid pressure in the space 132 is less than the fluid pressure downstream of the second valve means 135, such as at the outlet 104. In the embodiment shown, the second valve means 135 is a flapper valve.

Figure 8:
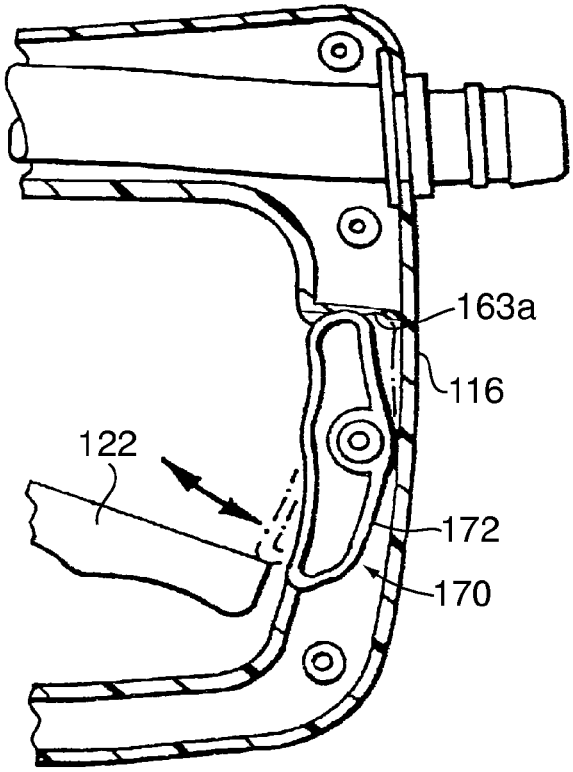
FIGS. 8*a* and 8*b* are fragmentary sectional elevation views of the fluid transfer apparatus of FIG. 2, illustrating the locking mechanism in locking and disabled conditions.
Figure 8A:
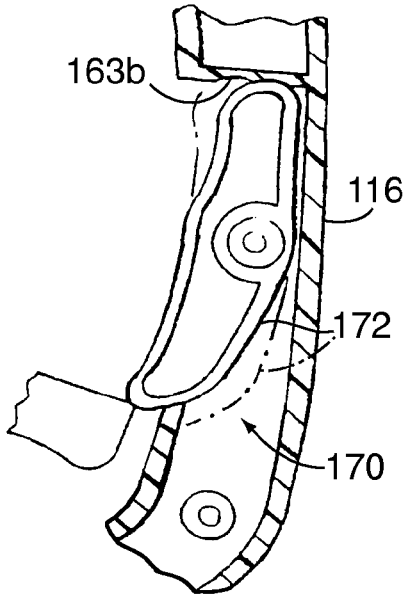

Preferably, to prevent inadvertent opening of the valve 112, a locking mechanism 170 is provided on the frame 116 of the fluid transfer apparatus 100. Referring to FIGS. 8*a* and 8*b*, the locking mechanism 170 includes a locking member 172 pivotally coupled to the frame 116. The locking member 172 is rotatable between a locking position and a disabled position in grooves 163*a*, 163*b* provided in the frame 116. In this respect, the locking member 172 is configured to effect snap fit engagement with the groove 163*a*, 163*b* to assume locking and disabled positions, respectively. When in the locking position, the locking member 172 is configured to engage the lever 122 when the sealing member 114 is sealingly engaged to the valve seat 110 to prevent upwardly movement of the lever 122, which would otherwise effect displacement of the sealing member 114 from the valve seat 110, resulting in opening of the valve 112.

The fluid transfer apparatus 200 is useful for effecting siphoning of liquid from the supply container 200 where the level of the liquid in the supply container 200 is elevated relative to the discharge of the apparatus 200 and a receiving container 300 provided to receive the discharge. To effect flow of liquid from the container 200, and its eventual discharge through outlet 104, lever 122 must be manually actuated to effect displacement of the valve 112 from the valve seat and, in concert, effect the expansion of the space 132 by movement of the flexible containment member 136.

Figure 4:
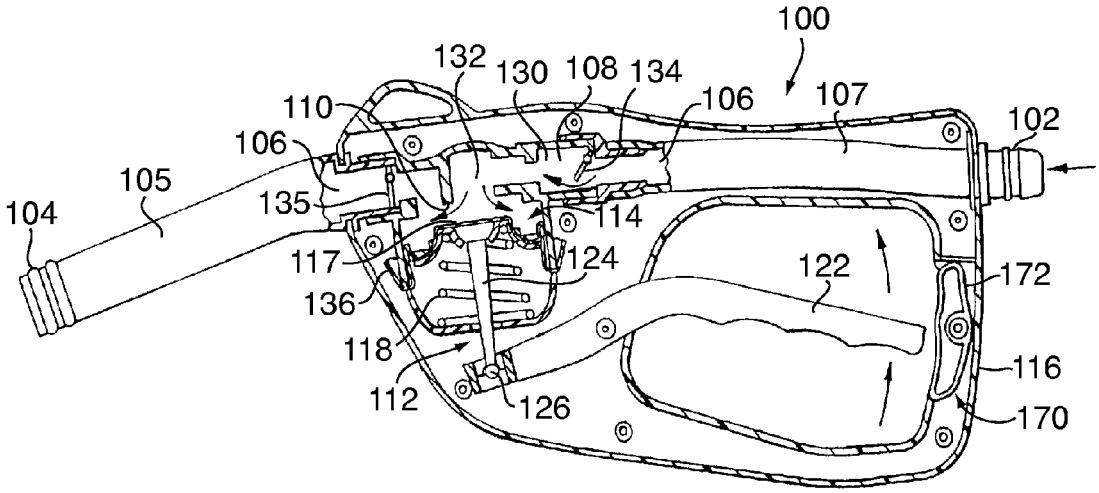
FIG. 4 is a sectional elevation view of the fluid transfer apparatus illustrated in FIG. 2, illustrating actuation of the lever in an upwardly direction to retract the valve from the valve seat and create a vacuum condition to initiate fluid transfer from the inlet.

To actuate the lever 122, the locking member 172 must be disposed in a disabled position, permitting upwardly movement of the lever 122. Referring to FIG. 4, pressing on the lever 122 in an upwardly direction effects displacement of the sealing member 114 from the valve seat 110 and opening of the orifice 108. Simultaneously, the flexible containment member 136 moves with the valve 112 and folds on itself to create a convolution proximate to the housing and thereby effect expansion of the space 132. Because of the expansion of the space 132, fluid pressure within the space 132 is reduced, and this is communicated to the first valve means 134 through the orifice 108, resulting in a pressure differential between the space 132 and the fluid passage 106 upstream of the first valve means 134. Eventually, this pressure differential overcomes the first biasing force urging the first valve means 134 to remain in a closed condition. This action initiates the flow of fluid (a liquid or a gas) into the fluid passage section 130 from the supply container 200. While this is happening, the second valve means 135 remains closed, owing to the second biasing force. The space 132 continues to be filled with the liquid and/or gas from the supply container 200 until the fluid pressure in the space 132 increases sufficiently such that the differential between the fluid pressure in the space 132 and upstream of the first-valve means 134 is insufficient to overcome the first biasing force which is urging the first valve means to seal fluid communication between the inlet 102 and the space 132, resulting in closing of the first valve means 134.

Figure 5:
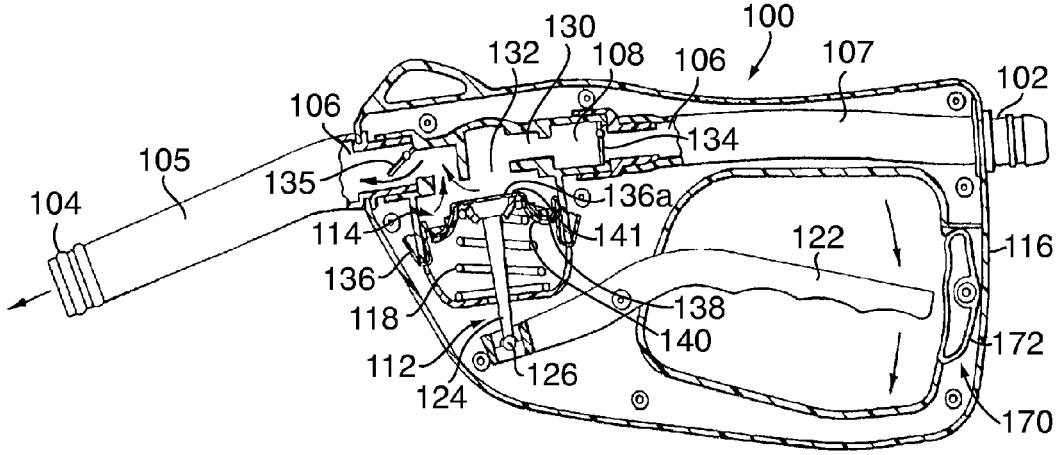
FIG. 5 is a sectional elevation view of the fluid transfer apparatus illustrated in FIG. 2, illustrating release of the lever to effect contraction of space within the fluid passage to thereby initiate pressurization and transfer of fluid through the outlet.
Figure 6:
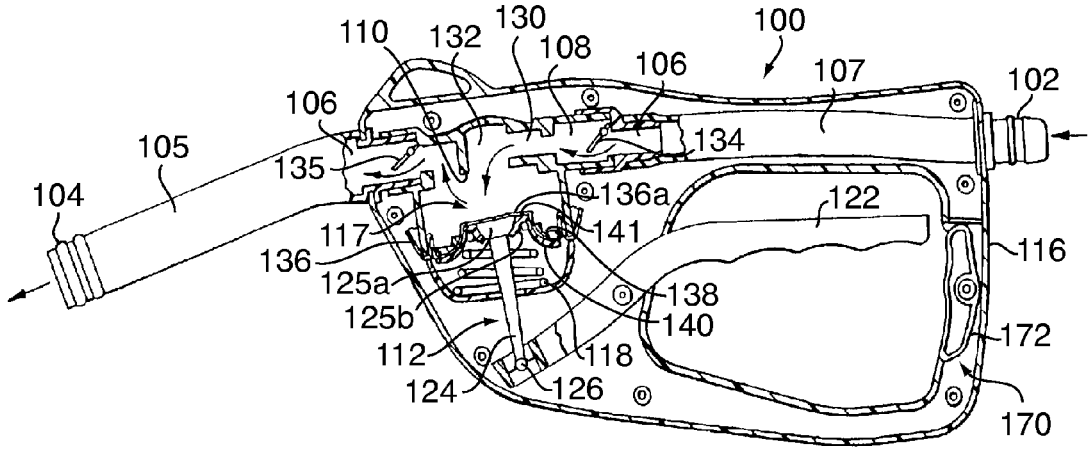
FIG. 6 is a sectional elevation view of the fluid transfer apparatus illustrated in FIG. 2, illustrating flow within the fluid transfer apparatus after siphoning has been established.

At least initially, the space 132 is not completed filled with liquid. Accordingly, in order to establish a siphoning process, it is necessary to displace gas from the space 132 and replace it with liquid from the supply container 200. To effect this, the direction of movement of the lever 122 must be reversed in order to effect contraction of the space 132 by the containment member 136, and thereby effecting displacement of fluid from the space 132 and past the second valve means 135 and through the outlet 102. Referring to FIG. 5, releasing the lever 122 effects movement of the flexible containment member 136 out of its convolution to effect contraction of the space 132 due to the urging by the spring 118. Contraction of the space 132 causes an increase in fluid pressure, and creates a fluid pressure differential between the space 132 and the outlet 104. The resulting fluid pressure differential force acts on the second valve means 135 and eventually is sufficient to overcome the second biasing force to effect opening of the second valve means 135. This causes displacement of the fluid from the space 132 and through the outlet 104. While this is happening, the first valve means 134 remains closed. Once the fluid pressure in the space 132 approaches the fluid pressure at the outlet 104, the second biasing force effects return of the second valve means 135 into the closed condition, thereby sealing fluid communication between the space 132 and the outlet 104.

The priming action of effecting alternating expansion/contraction of the space 132 eventually results in the fluid passage 106 being occupied by liquid from the supply container 200. When this happens, a siphoning process is established as the fluid pressure of the liquid will keep the second valve means 135 open, and liquid flow will continue from the supply container 200 so long as the liquid level in the supply container 200 is elevated relative to the outlet 104 (see FIG. 7). The rate of liquid flow during the siphoning can be controlled by the lever 122. If desired, the siphoning process can be stopped by pressing on the lever to effect sealing engagement between the sealing member 114 and the valve seat 110.

It will be understood, of course, that modifications can be made to the embodiments of the invention described herein without departing from the scope and purview of the invention as defined by the appended claims.

The invention claimed is:

1. A combination of a supply container and a fluid transfer apparatus, the fluid transfer apparatus disposed in fluid communication disposition with the liquid in the supply container to thereby effect creation and communication of a reduced fluid pressure relative to a fluid pressure of the liquid in the supply container and thereby initiating flow of the liquid from the supply container, the fluid transfer apparatus comprising:

a) a frame;

b) a conduit coupled to the frame and defining a fluid passage, the fluid passage including an inlet, and outlet, and an orifice defined by a valve seat, and the conduit including a conduit section having a flexible containment member and defining a first fluid passage section comprising a space capable of changing its volume, and wherein said first fluid passage section is defined between a first valve means and a second valve means, each of the first and second valve means being disposed in the first fluid passage section;

wherein said first valve means is biased to seal fluid communication between the inlet and the space to prevent fluid flow from the space to the inlet, and is configured to open in response to a fluid pressure differential between the inlet and the space, wherein fluid pressure in the space is less than fluid pressure at the inlet, sufficient to overcome the bias of the first valve means to seal fluid communication between the inlet and the space;

and wherein the second valve means is biased to seal fluid communication between the space and outlet to prevent fluid flow from the outlet to the space;

c) a moveable sealing member, coupled to the flexible containment member, and configured and biased to sealingly engage the valve seat; and d) an actuator, pivotally coupled to the frame, and coupled to the sealing member to effect an initial displacement of the sealing member relative to the valve seat and return thereto in response to pivotal movement of the actuator relative to the frame;

wherein said initial displacement of the sealing member from the valve seat by the actuator effects continuous expansion of the space until the displacement of the sealing member from the valve seat is at its greatest, thereby producing a reduced fluid pressure in the space sufficient to create the sufficient fluid pressure differential between the inlet and the space to overcome the bias of the first valve means to seal fluid communication between the inlet and the space, thereby effecting the creation and communication of the reduced fluid pressure to the liquid in the supply container.

2. The combination as claimed in claim 1, wherein the second valve means is configured to open in response to a fluid pressure differential between the space and the outlet, wherein fluid pressure in the space is greater than the fluid pressure at the outlet, sufficient to overcome the bias of the second valve means to seal fluid communication between the space and the outlet.

3. The combination as claimed in claim 1, wherein the flexible containment member is a flexible diaphragm.

4. A fluid transfer apparatus configured for fluid communication disposition with liquid in a supply container to thereby effect creation and communication of a reduced fluid pressure relative to a fluid pressure of the liquid in the supply container and thereby initiating flow of the liquid from the supply container, the fluid transfer apparatus comprising:

a) a frame;

b) a conduit coupled to the frame and defining a fluid passage, the fluid passage including an inlet, and outlet, an orifice defined by a valve seat, and the conduit including a conduit section having a flexible containment member and defining a first fluid passage section comprising a space capable of changing its volume, and wherein said first fluid passage section is defined between a first valve means and a second valve means, each of the first and second valve means being disposed in the first fluid passage;

wherein said first valve means is biased to seal fluid communication between the inlet and the space to prevent fluid flow from the space to the inlet, and is configured to open in response to a fluid pressure differential between the inlet and the space, wherein fluid pressure in the space is less than fluid pressure at the inlet, sufficient to overcome the bias of the first valve means to seal fluid communication between the inlet and the space;

and wherein the second valve means is biased to seal fluid communication between the space and outlet to prevent fluid flow from the outlet to the space;

c) a moveable sealing member, coupled to the flexible containment member, and configured and biased to sealingly engage the valve seat; and d) an actuator, pivotally coupled to the frame, and, coupled to the sealing member to effect an initial displacement of the sealing member relative to the valve seat and return thereto in response to pivotal movement of the actuator relative to the frame;

wherein said initial displacement of the sealing member from the valve seat by the actuator effects expansion of the space to thereby effect a reduced fluid pressure in the space sufficient to create the sufficient fluid pressure differential between the inlet and the space to overcome the bias of the first valve means to seal fluid communication between the inlet and the space, thereby effecting the creation and communication of the reduced fluid pressure to the liquid in the supply container.

5. The combination as claimed in claim 4, wherein the second valve means is configured to open in response to a fluid pressure differential between the space and the outlet, wherein fluid pressure in the space is greater than the fluid pressure at the outlet, sufficient to overcome the bias of the second valve means to seal fluid communication between the space and the outlet.

6. The combination as claimed in claim 4, wherein the flexible containment member is a flexible diaphragm.

7. A fluid transfer apparatus configured for fluid communication disposition with liquid in a supply container to thereby effect creation and communication of a reduced fluid pressure relative to a fluid pressure of the liquid in the supply container and thereby initiate flow of the liquid from the supply container, comprising:

a) a frame;

b) a conduit coupled to the frame and defining a fluid passage, the fluid passage including an inlet, and outlet, and an orifice defined by a valve seat, the conduit including a conduit section having a flexible containment member and defining a first fluid passage section comprising a space capable of changing its volume; and wherein said first fluid passage section is defined between a first valve means and a second valve means, each of the first and second valve means being disposed in the first fluid passage section;

wherein said first valve means is biased to seal fluid communication between the inlet and the space to prevent fluid flow from the space to the inlet, and is configured to open in response to a fluid pressure differential between the inlet and the space, wherein fluid pressure in the space is less than fluid pressure at the inlet, sufficient to overcome the bias of the first valve means to seal fluid communication between the inlet and the space;

and wherein the second valve means is biased to seal fluid communication between the space and outlet to prevent fluid flow from the outlet to the space;

c) a moveable sealing member, coupled to the flexible containment member, and configured and biased for sealingly engaging the valve seat;

d) an actuator, pivotally coupled to the frame, and configured to effect an initial displacement of the sealing member relative to the valve seat and return thereto in response to pivotal movement of the actuator relative to the frame; and e) locking means pivotally coupled to the frame and configured to engage the actuator to prevent the actuator from effecting displacement of the sealing member when the sealing member is sealingly engaged to the valve seat;

wherein said initial displacement of the sealing member from the valve seat by the actuator effects continuous expansion of the space until the displacement of the sealing member from the valve seat is at its greatest, thereby producing a reduced fluid pressure in the space sufficient to create the sufficient fluid pressure differential between the inlet and the space to overcome the bias of the first valve means to seal fluid communication between the inlet and the space, thereby effecting the creation and communication of the reduced fluid pressure to the liquid in the supply container.

8. The fluid transfer apparatus as claimed in claim 7, wherein the locking means is moveable between a locking condition and a disabled condition such that, in the locking condition, the locking means prevents the actuator from effecting displacement of the sealing member when the sealing member is sealingly engaged to the valve seat, and in the disabled condition, the actuator is moveable to effect displacement of the sealing member.

9. The fluid transfer apparatus as claimed in claim 8, wherein the frame includes a first receiving means for releasably engaging the locking means in the locking condition, and a second receiving means for releasably engaging the locking means in the disabled condition.

10. The fluid transfer apparatus as claimed in claim 9, wherein the locking means is configured to effect snap fit engagement with each of the first and second receiving means.

11. The fluid transfer apparatus as claimed in claim 10, wherein each of the first and second receiving means is a groove provided in the frame.

* * * * *